US005463918A

United States Patent [19]

Lemieux et al.

[11] Patent Number: 5,463,918

[45] Date of Patent: Nov. 7, 1995

[54] HAND TOOL EXTENSION HANDLE

[76] Inventors: Thomas Lemieux, N. 1204 Locust, Spokane, Wash. 99214; Rod Nelson, E. 8804 Sinto, Spokane, Wash. 99212

[21] Appl. No.: 76,559

[22] Filed: Jun. 11, 1993

[51] Int. Cl.[6] ..... A47F 13/06

[52] U.S. Cl. ..... 81/487; 294/19.1

[58] Field of Search ..... 81/487, 177.2; 294/19.1, 22

[56] References Cited

U.S. PATENT DOCUMENTS

| | | | |
|---|---|---|---|
| 4,147,220 | 4/1979 | Swiderski et al. | 294/19.1 |
| 5,096,244 | 3/1992 | Wilson et al. | 294/19.1 |
| 5,135,388 | 8/1992 | Pettit | 294/19.1 |

*Primary Examiner*—D. S. Meislin

*Attorney, Agent, or Firm*—Wells, St. John, Roberts, Gregory & Matkins

[57] ABSTRACT

Our invention generally provides an extension handle which attaches to hand-power tools, more particularly, nail guns, and not only increases the distance between the hand-power tool and the operator's hand, but also provides a remote triggering mechanism which controls the triggering mechanism on the hand-power tool. Our extension handle generally includes a handle, an adjustable extension arm, a device to attach and position the extension arm to the hand-power tool, and a remote triggering mechanism to allow engagement and disengagement of the triggering mechanism of the hand-power tool from the handle of the extension handle.

1 Claim, 2 Drawing Sheets

HAND TOOL EXTENSION HANDLE

FIELD OF INVENTION

This invention generally pertains to an extension handle for use on hand-power tools, which includes a handle, a remote triggering mechanism, and a means to attach the apparatus to the hand-power tool such that the hand-power tool is not only held, but the triggering mechanism can be remotely engaged and disengage the hand power tool.

BACKGROUND OF THE INVENTION

For many years, hand-powered tools have been used in the construction industry for such functions as stapling, nailing, sawing, and others. The higher quality professional hand tools are typically larger in size, heavier, and more durable.

In applications of hand tools where there is much repetition and where the operator must continually bend or lean over in order to use the tool, worker fatigue and injury increase. A good example of this is a construction worker utilizing a nail gun on a large, flat or low sloped roof. The worker generally holds the nail gun by the handle and in a bent-over position, engages the triggering mechanism to shoot the nail into the wood or other object being nailed. On a large roof, a worker may be performing this task for several hours a day and walking along, bending over or on his knees, hunched over, and driving nail after nail or staple after staple into the roof to attach roofing materials.

This procedure creates repetitious stress and strain on the lower back, and causes worker discomfort and increases the number of worker injuries and workman's compensation claims. Prior art has attempted to devise extension handles that accomplished the ultimate purpose of saving workers from leaning and bending over and from injury; however, prior art has heretofore been unable to devise any such apparatus that can easily be fitted onto most hand tools, and which is easy to operate, simple in design, and relatively inexpensive.

Our invention provides a relatively inexpensive, simple and ergonomic extension handle that can be quickly and easily attached to a power-hand tool, such as a nail gun, used for the intended purpose, and then quickly and easily removed.

SUMMARY OF THE INVENTION

Our invention, a hand-power tool extension handle and triggering mechanism, generally includes a handle, an extension arm, a means to attach said extension arm to different hand-power tools, and a means to remotely engage and disengage the trigger mechanism on the hand-power tool.

It is an object of our invention to reduce worker soreness and injury in the repetitious use of a hand-power tool wherein the worker must repetitionsly bend or lean over to operate the power tool. An advantage of our invention is that it allows use of the hand-power tool through an extension handle, such that the worker can operate the tool in a substantially upright position, thereby reducing the repetitious bending or leaning over and consequent fatigue and injury.

Another object of this invention is to provide an extension handle, as described above, which is relatively simple, ergonomic, relatively inexpensive to manufacture and relatively safe to operate. An advantage to our invention is the use of rugged material and components and with relatively few components, thereby reducing the propensity for component failure and reducing the expense of manufacture.

It is a further object of our invention to provide an extension handle, as described herein, which can easily be attached and detached to a variety of different hand tools, to include a variety of different nail gun hand-power tools and brands of tools. An advantage of our invention is its ability not only to easily attach at detach to hand-power tools of different handle sizes and configurations, but also its ability of its remote triggering mechanism to engage and disengage the triggering mechanism of the hand-power tool to which the extension handle is attached.

Other objects, features, and advantages of this invention will appear from the specification, claims, and accompanying drawings which form a part hereof. In carrying out the objects of this invention, it is to be understood that its essential features are susceptible to change in design and structural arrangement, with only one practical and preferred embodiment being illustrated in the accompanying drawings, as required.

BRIEF DESCRIPTION OF DRAWINGS

In the accompanying drawings, which form a part hereof.

DESCRIPTION OF THE PREFERRED EMBODIMENT

Our invention, a hand-power tool extension handle and triggering mechanism, generally includes the basic components of a handle means 1, an extension arm means 3, a means to attach said extension arm means 3 to different hand-power tools, and a means to remotely control 6 the trigger mechanism on hand-power tools.

Many of the fastening, connection and wiring means and other components utilized in this invention are widely known and used in the field of the invention described, and their exact nature or type is not necessary for an understanding and use of the invention by a person skilled in the art or science, and they will not therefore be discussed in significant detail.

The various components shown or described herein for any specific application of this invention can be varied or altered as anticipated by this invention. This invention comprises a unique combination of elements, each element of which can be accomplished by one of several different means or variations for a specific application of this invention. The practice of a specific application of any element may already be widely known or used in the art or by persons skilled in the art or science and each will not therefore be discussed in significant detail.

There are certain variations or modifications which can be made to these generally known components to facilitate different applications of this invention without changing the nature of what is claimed by this invention, as is set forth more fully herein. By way of example, most of the components contemplated herein are made of steel of some sort, however, they can be made by other materials suitable for the intended purpose, such as high strength plastics, ceramics in some cases, and others, without varying from the invention, which is the combination of elements.

Although the majority of the description contained herein are directed toward the application of this invention to a nail gun, this invention is not limited to use with nail guns, but is applicable more generally to hand-power tools, and specifically includes nail guns and staple guns, and the description applies equally regardless of what particular application the invention is being applied to.

Figure 1:
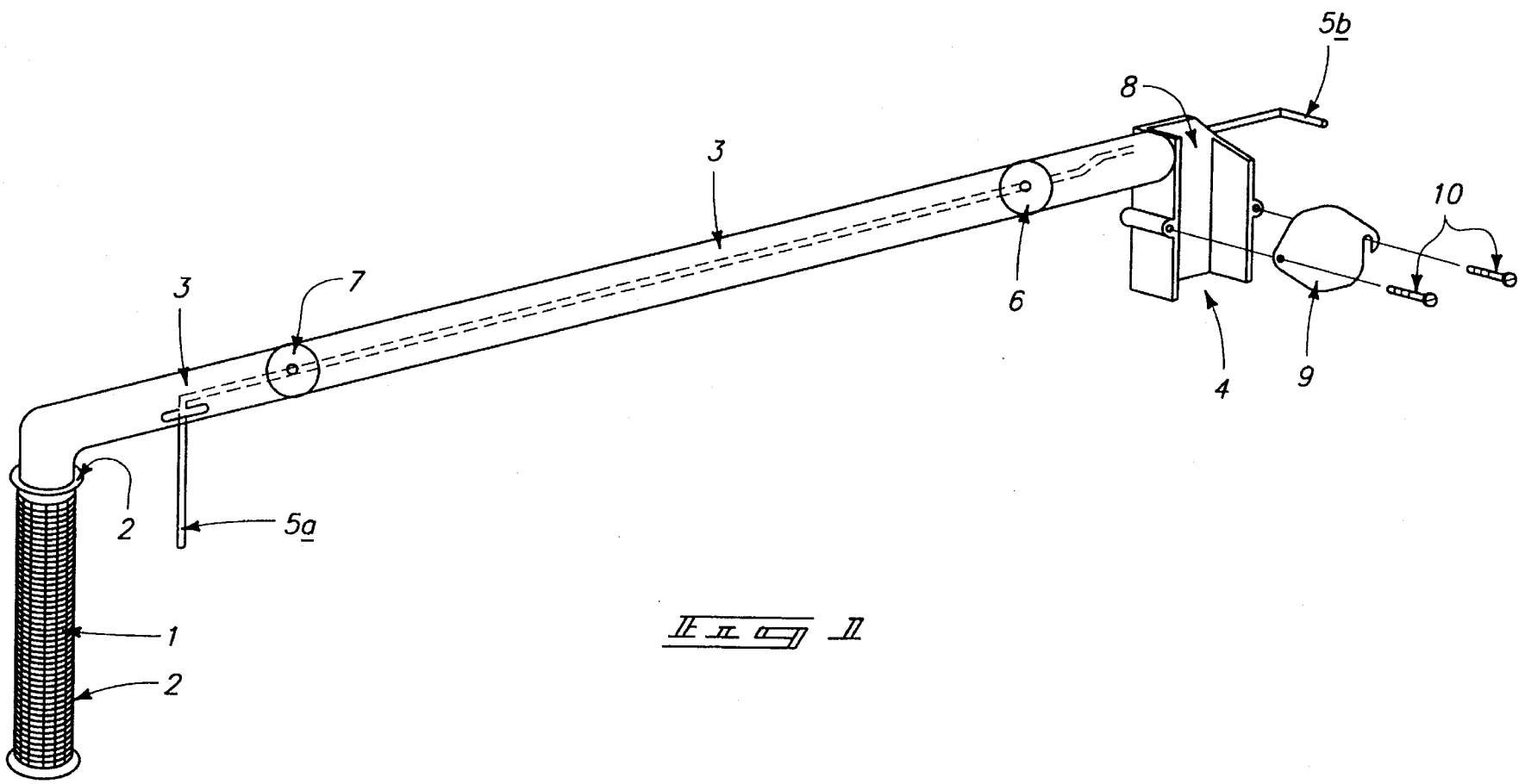
FIG. 1 is a prospective view of the preferred embodiment of the extension handle.

FIG. 1 shows one means to accomplish the invention for use on a typical nail gun used in construction.

The handle means 1, within the contemplation of this invention, can be accomplished in a number of different ways, so long as a means to hold on to and control the physical location of the hand tool is provided. The handle means 1 shown in FIG. 1 is a circular tube at an approximate ninety degree angle to the extension arm means 3 and fixed to the extension arm means 3 by a weld. The handle means 1 also includes a grip 2 such as a typical motorcycle handlebar grip to facilitate better, firmer gripping of the handle means 1.

The handle means 1 configuration shown in FIG. 1 has been found to offer the most comfortable balance when holding a nail gun in the configuration shown.

The handle means 1 can be in any position relative to the extension arm means 3 and fixed to the extension arm means 3 in a variety of different ways. The handle means 1 can also be of split configuration whereby supports from the extension arm means 3 split off into two parts and surround a handle means 1. The handle means 1 within the contemplation of this invention can even be a location at the end of and on the extension arm means 3 where the extension arm can be handled.

The extension arm means 3, within the contemplation of this invention, can be provided in a number of different ways, such as by hollow tubular material or solid core material. If the extension arm means 3 is a solid core piece, then eyelets or guides would need to be attached to the exterior of the extension arm means 3 to guide the means to remotely control 6 a trigger means.

The extension arm means 3 shown in FIG. 1 is a hollow, steel tube, connected at one end to the handle means 1, and connected to and securing at the other end, a means to attach 4 the extension arm means 3 to different hand-power tools.

The extension arm means 3 can be of any cross-sectional shape or dimensions and can even be accomplished by known means for providing adjustable length tubing to allow the operator to adjust the length to fit the job and the operator. In the case where the extension arm means 3 is adjustable, the means to remotely control 6 a trigger means on the hand-power tools must likewise be provided in a way such that it is adjustable.

The means to attach 4 the extension arm means 3 to different hand-power tools, within the contemplation of this invention, can be accomplished in a variety of different ways so long as it facilitates the firm attachment of the extension arm means 3 to the handle portion of the hand-power tool. The means to attach 4 the extension arm means 3 to different hand-power tools, can also be made such that it is easily attachable and detachable to the handle portion of the hand-power tool.

The means to attach 4 the extension arm means 3 to different hand-power tools shown in FIG. 1 is generally a three sided, U-shaped channel member 8 and a plate member 9 which completes the general enclosure around the handle of the hand-power tool. In FIG. 1, the plate member 9 is attached and detached to the channel member 8 by means of two screws 10 which can pass through and attach to either the channel member 8 or the plate member 9, or a combination thereof.

Additional components can be added to the means to attach 4 the extension arm means 3 to different hand-power tools, such as rubber inserts and other means to allow the invention to be tightly fitted and attached to the hand-power tool. For ease of use, wing-nut screws can also be used as the means to attach 4 the plate member to the channel member.

The important requirement for the means to attach 4 the extension arm means 3 to different hand-power tools is that it can be firmly attached to, and surround if necessary, the handle on the hand-power tool.

It is also within the contemplation of our invention that the means to attach 4 the extension arm means 3 to different hand-power tools can be comprised of a fixed size rectangular or box shaped member attached to the extension arm means 3 and into which a similarly shaped internal component can be inserted and then fixed by whatever means. The external configuration of the internal component will correspond to the shape and size of the interior of the outer member, while the internal portion thereof can be molded to precisely fit the shape and contour of the specific hand-power tool to which it is desired to be attached.

The means to remotely control a trigger means on the hand-power tools, within the contemplation of this invention, is comprised of a bent rod 5, which includes trigger means **5*a* which can easily be accessed and operated by the operator at or near the handle means 1, and an engagement means 5*b* at the hand-power tool end of the bent rod 5**, which responds to the operator's control to activate and de-activate the trigger mechanism on the hand power tool. The means to remotely control the trigger on the hand-power tool is also preferably biased such that if at rest is not engaging the trigger mechanism on the hand-power tool.

The means to remotely control the trigger on the hand-power tools shown in FIG. 1 is a solid bent rod 5 at the handle means 1 end to emulate a trigger means **5*a*, and bent in an arcuate configuration at the opposite end, the engagement means 5*b***, to be in a position to engage the trigger mechanism of the hand-power tool.

Figure 2:
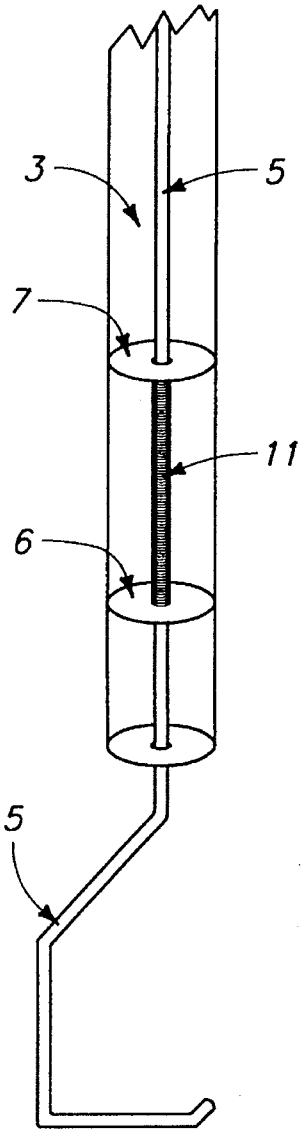
FIG. 2 is a view of the spring bias means.

As shown in FIG. 2, in order to provide the spring bias means, a first washer 6 is fixed to the portion of the bent rod that is within the tubular extension arm means 3, and a second washer 7 is fixed to the interior walls of the extension arm means 3 and a spring means 11 is placed between the two washers such that the bent rod 5 is biased in the non-engaging position. A variety of other known biasing means can also be utilized to accomplish the invention.

The means to remotely control the trigger mechanism on the hand-power tool can also be accomplished using a variety of different materials, such as string or wire instead of the solid bent rod 5.

While the preferred embodiment for the invention has been described in detail, those familiar with the art to which this invention relates will recognize various alternative designs and embodiments for carrying out the invention, as defined by the claims which follow.

The invention we claim is:

1. An extension handle and remote triggering mechanism for hand-power tools, which comprises:

a. a handle means;

b. an extension arm means, including a first end attached to said handle means;

c. a means to attach a second end of the extension arm means to a hand-power tool and which comprises a U-shaped channel attached to said extension arm means and an attachment plate which is releasably and adjustably attachable to said channel such that the U-shaped channel and the attachment plate firmly attach to the handle of the hand-power tool; and d. a means to remotely control a trigger means on the hand-power tool, a first end of which is located at or near the handle means so that an operator can easily engage it and a second end which is positioned relative to the trigger means of the hand-power tool such that when the first end is engaged by the operator, it causes the second end to actuate the trigger means on the hand-power tool.

* * * * *